US006415122B1

(12) United States Patent
Hara et al.

(10) Patent No.: US 6,415,122 B1
(45) Date of Patent: Jul. 2, 2002

(54) ELECTROPHOTOGRAPHIC IMAGE-FORMING METHOD AND APPARATUS

(75) Inventors: Hidetoshi Hara, Shiga; Shigehiro Hano, Otsu, both of (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 09/700,038

(22) PCT Filed: Mar. 10, 2000

(86) PCT No.: PCT/JP00/01484

§ 371 (c)(1),
(2), (4) Date: Nov. 9, 2000

(87) PCT Pub. No.: WO00/55695

PCT Pub. Date: Sep. 21, 2000

(30) Foreign Application Priority Data

Mar. 12, 1999 (JP) ..... 11-067463

(51) Int. Cl.[7] ..... G03G 15/02; G03G 21/00
(52) U.S. Cl. ..... 399/128; 399/50; 399/168
(58) Field of Search ..... 399/128, 50, 168

(56) References Cited

U.S. PATENT DOCUMENTS 4,063,811 A * 12/1977 Seino et al. ..... 399/128
4,623,243 A * 11/1986 Iijima et al. ..... 399/128
4,757,345 A * 7/1988 Ohashi et al. ..... 399/128
4,943,863 A * 7/1990 Ainoya ..... 399/297
5,749,029 A * 5/1998 Umeda ..... 399/128

FOREIGN PATENT DOCUMENTS

| | | |
|---|---|---|
| JP | 59180575 A | 10/1984 |
| JP | 6194859 | 6/1986 |
| JP | 62116987 A | 5/1987 |
| JP | 62150377 A | 7/1987 |
| JP | 1170974 A | 7/1989 |
| JP | 4104186 A | 4/1992 |
| JP | 683249 A | 3/1994 |
| JP | 6167905 A | 6/1994 |
| JP | 7209932 A | 8/1995 |
| JP | 7234618 A | 9/1995 |
| JP | 9185301 A | 7/1997 |

* cited by examiner

*Primary Examiner*—Fred L Braun
(74) *Attorney, Agent, or Firm*—Birch, Stewart, Kolasch & Birch, LLP

(57) ABSTRACT

An image forming method and image forming apparatus in which a toner image formed on an image carrier (11) through steps of discharging, main charging, exposure and development is transferred to a recording medium (S) and then fixed as an image using flash light. The image forming apparatus (10) has a secondary charger (17) for secondarily charging the image carrier to have the same polarity as a polarity given by a main charger (12) and a surface potential larger in absolute value than a surface potential given by the main charger.

12 Claims, 6 Drawing Sheets

HAVING LARGE TENDENCY TO PRODUCE TRANSFER MEMORY
HAVING SMALL TENDENCY TO PRODUCE TRANSFER MEMORY
AFTER EXPOSURE USING LED ARRAY
0V
PORTION ON WHICH FLASH LIGHT HAS IMPINGED
AFTER TRANSFER (AFTER FLASH LIGHT IS APPLIED)
0V
AFTER SECONDARY CHARGING
890V
0V
AFTER DISCHARGING
0V
AFTER MAIN CHARGING
680V
0V

ELECTROPHOTOGRAPHIC IMAGE-FORMING METHOD AND APPARATUS

This application is the national phase under 35 U.S.C. §371 of PCT International Application No. PCT/JP00/01484 which has an-International filing date of Mar. 10, 2000, which designated the United States of America.

TECHNICAL FIELD

The present invention relates to an image forming method and an image forming apparatus.

BACKGROUND ART

In an electrophotographic image forming apparatus, light is applied to a uniformly charged surface of an image carrier such as a photoconductive drum or a photoconductive belt in accordance with printing information to thereby form an electrostatic latent image, then the electrostatic latent image is developed with toner particles, and then the developed toner image is transferred to a recording medium such as paper or resin film and fixed using heat, pressure, light or the like.

The most general way of fixing the toner image is the way using heat rolls. However, the fixing using heat rolls has the following problems: Though heat efficiency is high, initial heating (rising) takes several minutes. Further, toner is apt to be put out of position onto the heat rolls and stain the recording paper. Further, since the recording medium is nipped by a pair of heat rolls, when the recording medium is continuous paper such as paper for computer output, wrinkles and breaks, are apt to be produced due to the paper's meandering.

In the case of an image forming apparatus using radiant energy of flash light intermittently emitted from a flash lamp such as a xenon light source, toner absorbs radiant energy selectively and enables high-speed fixing. Further, in flash fixing, a flash lamp and recording paper are not in contact. This has an advantage that there is no fear of toner's being put out of position, or wrinkles and breaks being produced due to the recording medium's meandering. Another advantage is that a toner image is fixed easily even to sized paper.

In the flash-fixing type image forming apparatus, part of flash light can impinge on the photoconductor as leak light, directly or indirectly, that is, having been reflected by a reflecting plate or shielding plate attached to the flash lamp, a carrying belt, paper and/or the like, in accordance with the flash lamp periodically emitting the flash light, intermittently. This can produce stains on a white ground.

When cut sheet paper is used, the flash-lamp side of the carrying belt is exposed between cut sheets. Therefore, for example, if antireflection treatment such as black coating is applied to the carrying belt, it may reduce the leak light from the flash lamp impinging on the photoconductor. However, when continuous paper is used, the carrying belt is not exposed. Therefore, more intensive leak light from the flash lamp may impinge on the photoconductor. In that case, photo fatigue and transfer memory may be produced at those portions of the photoconductor on which the flash light has impinged, so that the capability to be charged may drop.

Here, photo fatigue means that the capability of the photoconductor to be charged drops at its portions that have received intensive light. As shown in FIG. 4, photo fatigue can be evaluated as follows: After electricity is removed from a photoconductor 1 by a discharging lamp 2, the photoconductor 1 is charged by a main charger 3. Then, flash light from a flash lamp 5 is applied to the photoconductor 1 through a slit 4. A decrease in surface potential Δ1 of the surface of the photoconductor 1 caused by the flash lamp 5 being turned on after the main charging (as shown in FIG. 5) is measured with a surface potential sensor 7 to thereby evaluate photo fatigue.

Transfer memory means, as shown in FIG. 6, that electric charge supplied by a transfer charger 6 having a polarity opposite to the polarity of the photoconductor 1 remains until directly before charging by a main charger 3, so that an increase in surface potential caused by the charging by the main charger 3 reduces, that is, the capability to be charged drops. Transfer memory can be evaluated as follows: After electricity is removed from the photoconductor 1 by the discharging lamp 2, the photoconductor 1 is charged by the main charger 3. Then, the photoconductor 1 is subjected to transfer charging by the transfer charger 6 whose polarity is opposite to the polarity of the main charging. Then, a decrease in surface potential Δ2 of the surface of the photoconductor 1 after the main charging (as shown in FIG. 7) is measured with a surface potential sensor 7 to thereby evaluate transfer memory. A larger decrease in surface potential Δ2 means a larger tendency to produce transfer memory.

Transfer memory is apt to be produced in reversal development using a transfer charger whose polarity is opposite to the polarity of a photoconductor. Therefore, generally, the capability to be charged drops more in reversal development in which both photo fatigue and transfer memory affect the capability than in normal development in which only photo fatigue affects it.

Further, when flash light impinges on a photoconductor that is under transfer charging by a transfer charger, the photoconductor is charged to have a polarity opposite to the polarity of the transfer charger at the same time that the flash light causes a decrease in surface potential of the photoconductor. Thus, the capability to be charged drops more. Further, the more the photoconductor is deteriorated due to repeated printing, the more the capability to be charged drops due to photo fatigue and transfer memory. FIG. 8 shows how the surface potential of the deteriorated photoconductor varies after each step.

As shown in FIG. 8, the capability of the photoconductor to be charged drops at its portions that have received flash light. Portions that have a lower surface potential after main charging are produced in accordance with the flash light being emitted periodically. If a decrease in surface potential ΔV is large, it may cause stains on a white ground in reversal development and decrease in concentration in normal development.

A Various kinds of photoconductors such as amorphous silicon, selenium, cadmium sulfide and organic photoconductors show such drop in capability to be charged. Especially in the case of a positively-charged single-layer type organic photoconductor, electrons are apt to remain and drop in capability to be charged, therefore, decrease in surface potential ΔV is particularly large, as shown in Unexamined Japanese Patent Publication (KOKAI) No. Hei 7-234618.

To deal with this problem, it is possible to make a paper carrying path on the flash lamp side sharply bent relative to a paper carrying path on the photoconductor side to thereby reduce the amount of flash light impinging on a photoconductor to thereby reduce drop in capability to be charged. However, when the paper carrying path is bent, thick paper and sized paper may not be carried well. Further, a toner image not fixed yet may touch a carrying guide and the like and cause deterioration in printing.

It is also possible to reduce the output of a flash lamp to thereby reduce the amount of flash light impinging on a photoconductor. However, this makes a toner image fixed to a recording medium worse.

The present invention has been made in view of the above problems. The object of the present invention is to provide an image forming method and image forming apparatus in which a recording medium is carried well and the possibility of producing stains on a white ground is low even if flash light impinges on an image carrier.

DISCLOSURE OF THE INVENTION

In order to attain the above object, the present invention provides an image forming method in which a toner image formed on an image carrier through steps of discharging, main charging, exposure and development is transferred to a recording medium and then fixed as an image using flash light, wherein after the toner image is transferred, the image carrier is subjected, prior to discharging, to secondary charging that gives the same polarity as the main charging gives and a surface potential larger in absolute value than the main charging gives.

Desirably, the recording medium is continuous paper.

Desirably, a carrying path along which the recording medium is carried while the toner image is transferred and then fixed is substantially a straight line.

Desirably, the development through which the toner image is formed is reversal development.

Desirably, the image carrier is an organic photoconductor.

Desirably, the flash light is emitted from a plurality of light sources simultaneously.

Further, in order to attain the above object, the present invention provides an image forming apparatus comprising at least an image carrier, main charging means, exposure means, development means, transfer means for transferring an image to a recording medium, discharging means, fixing means using a flash lamp, carrying means for carrying the recording medium from transfer position to fixing position, and secondary charging means for secondarily charging the image carrier to have the same polarity as a polarity given by the main charging means and a surface potential larger in absolute value than a surface potential given by the main charging means, the secondary charging means being arranged to act on the image carrier after the transfer means acts on the image carrier and before the discharging means acts on the image carrier.

Desirably, the recording medium is continuous paper.

Desirably, the carrying means carries the recording medium along a carrying path that is substantially a straight line.

Desirably, the development means is means for performing reversal development.

Desirably, the image carrier is an organic photoconductor.

Desirably, the fixing means comprises a plurality of flash lamps adapted to emit light simultaneously.

It is to be noted that in the specification, "larger surface potential" means surface potential larger in absolute value. Further, in the specification, the absolute value of surface potential means the maximum in absolute value of surface potential that varies during printing.

BEST MODE OF CARRYING OUT THE INVENTION

An embodiment of an image forming method and image forming apparatus of the present invention will be described in detail based on an electrophotographic printer 10 shown in FIG. 1.

Figure 1:
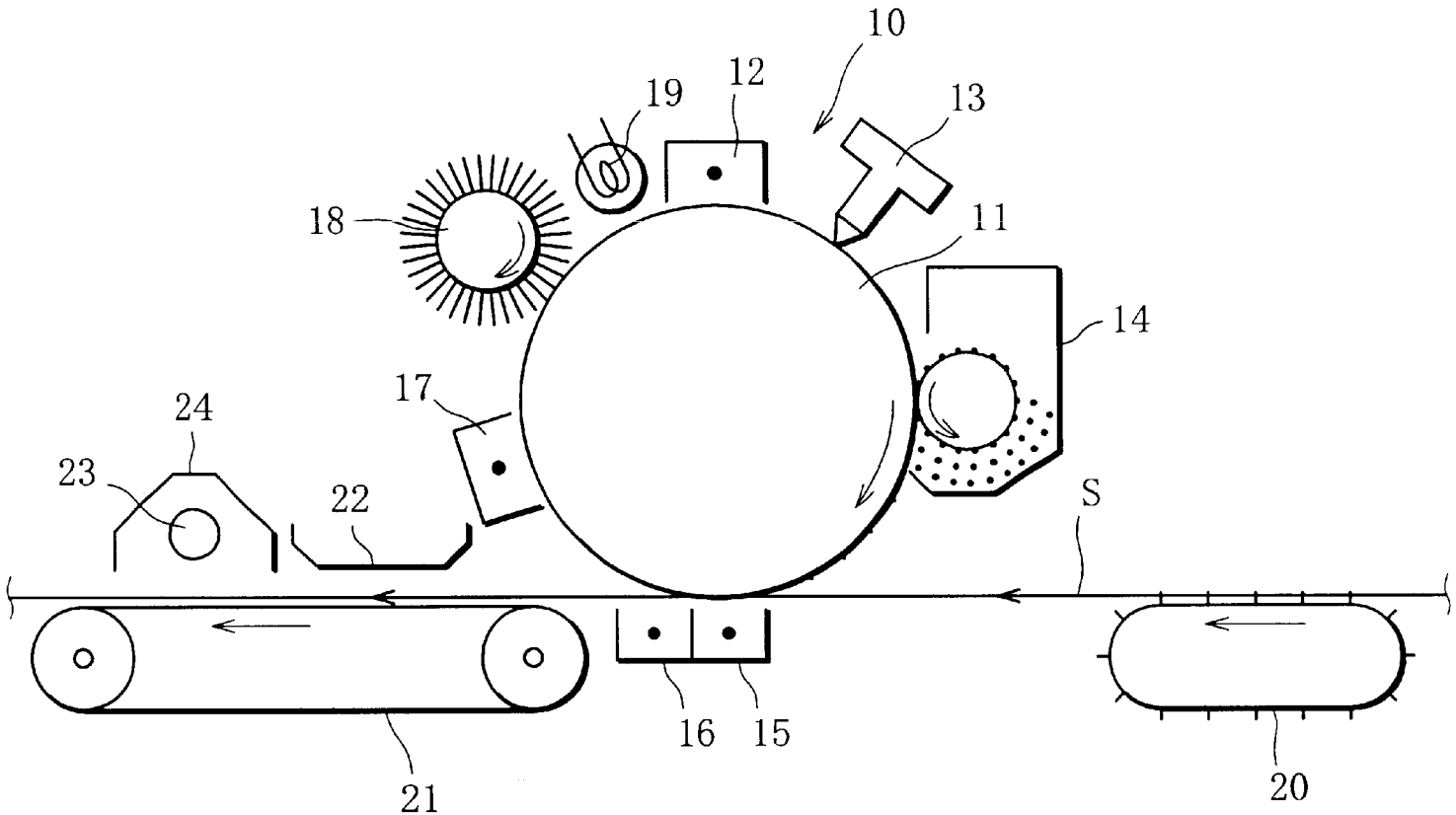
FIG. 1 shows a schematic structure of an electrophotographic printer to which an image forming method and image forming apparatus of the present invention is applied.

As shown in FIG. 1, the electrophotographic printer 10 comprises a main charger 12, an LED array 13, a developer unit 14, a transfer charger 15, a separate charger 16, a secondary charger 17, a cleaner 18 and a discharging lamp 19 which are arranged around a photoconductor 11. The electrophotographic printer 10 further comprises a tractor 20 that provides a carrying-in path along which paper S is carried to the transfer charger 15, a carrying belt 21 that provides a carrying-out path along which paper S is carried from the separate charger 16, and a shielding plate 22, a flash lamp 23 and a reflector 24 which are arranged opposite to the carrying belt 21.

The photoconductor 11 is a positively-charged single-layer type organic photoconductor, for example, Marine-2 manufactured by Mita Kogyo Kabushiki Kaisha.

As charge producing material for the positively-charged single-layer type organic photoconductor, any material that a person skilled in the art usually uses may be used, but organic photoconductive pigments are desirable. As such, phthalocyanine pigment, perylene pigment, quinacridon pigment, pyranthrone pigment, bis-azo pigment, tri-azo pigment and the like can be mentioned. One of those organic photoconductive pigments may be used singly, or two or more of those organic photoconductive pigments may be used together.

A charge transporting medium can be prepared by having charge transporting material dispersed in binding resin.

As charge transporting material, any hole transporting substance or electron transporting substance that a person skilled in the art usually uses may be used.

As hole transporting substances, phenylendiamine compounds such as N,N,N',N'-tetrakis(3-methylphenyl)-m-phenylenediamine, poly-N-vinylcarbazole, phenanthrene, N-ethylcarbazole, 2,5-diphenyl-1,3,4-oxadiazole, 2,5-bis(4-diethylaminophenyl)-1,3,4-oxadiazole, bis-diethylaminophenyl-1,3,6-oxadiazole, 4,4'-bis(diethylamino)-2,2'-dimethyltriphenylmethane, 2,4,5-triaminophenylimidazole, 2,5-bis(4-diethylaminophenyl)-1,3,4-triazole, 1-phenyl-3-(4-diethylaminostyryl)-5-(4-diethylaminophenyl)-2-pyrazoline, p-diethylaminobenzaldehyde-(diphenylhydrazone) and the like can be mentioned. One of those substances may be used singly, or two or more of those substances may be used together.

As electron transporting substances, phenoquinones such as 3,5,3',5'-tetraphenyldiphenoquinone, 2-nitro-9-fluorenone, 2,7-dinitro-9-fluorenone, 2,4,7-trinitro-9-fluorenone, 2,4,5,7-tetranitro-9-fluorenone, 2-nitrobenzothiophene, 2,4,8-trinitrothioxanthone, dinitroanthracene, dinitroacridine, dinitroanthoquinone and the like can be mentioned. One of those substances may be used singly, or two or more of those substances may be used together.

As binding resin, various polymers can be enumerated such as styrene polymer, styrene-butadiene copolymer, styrene-acrylonitrile copolymer, styrene-maleic acid copolymer, acrylic polymer, styrene-acrylic copolymer, styrene-vinyl acetate copolymer, polyvinyl chloride, vinyl chloride-vinyl acetate copolymer, polyester, alkyd resin, polyamide, polyurethane, epoxy resin, polycarbonate, polyarylate, polysulfone, diarylphthalate resin, silicone resin, ketone resin, polyvinylbutyral resin, polyether resin, phenolic resin; and photo-curing resins such as epoxyacrylate, urethaneacrylate and the like. Photoconductive polymers such as poly-N-vinylcarbazole and the like can also be used as binding resin.

As a photoconductor 11, also a negatively-charged laminated organic photoconductor may be used. In that case, phthalocyanine pigment, anthoanthorone pigment, dibenzpyrene pigment, pyranthrone pigment, azo pigment, indigo pigment, quinacridon pigment, pyrylium dye, thiapyrylium dye, xanthene pigment, quinoneimine pigment, triphenylmethane pigment, styryl pigment and the like can be mentioned as charge producing materials.

Charge producing materials are not limited to those mentioned above. One kind of charge producing material may be used singly, or two or more kinds of charge producing materials may be mixed together and used.

A charge transporting layer can be formed by applying the charge transporting material as mentioned above on a substrate, if necessary, together with suitable binder. (Binder is not always needed.)

The mean particle diameter of charge producing material in its dispersed state is desirably not larger than 3 $\mu$m, more desirably not larger than 1 $\mu$m.

The manner of applying the material can be dip coating, spray coating, spinner coating, bead coating, wire bar coating, blade coating, roller coating, curtain coating or the like.

The charge transporting layer is electrically connected with a charge producing layer. The charge transporting layer has a function of receiving charge carriers injected from the charge producing layer under the influence of an electric field and transporting those charge carriers.

The charge transporting layer is formed on the charge producing layer.

The charge transporting layer is formed by applying a coat of organic charge transporting material such as a hydrazone compound, a pyrazoline compound, a stilbene compound, an oxazole compound, a thiazole compound, a triarylmethan compound or the like, if necessary, together with binder resin.

The charge transporting layer may also be formed using inorganic semiconductor powder such as pigment-sensitized zinc oxide, selenium, amorphous silicon or the like. The charge transporting layer may be formed by depositing such material.

The main charger 12 is a positive scorotron charger, and the transfer charger 15 is a negative corotron charger. The separate charger 16 is a corotron charger to which alternating voltage is applied, and the secondary charger 17 is a positive corotron charger. The cleaner 18 comprises a conductive brush and rotates in the direction indicated by an arrow.

The flash lamp 23 may be a xenon lamp, a neon lamp, an argon lamp, a kripton lamp or the like. In the present embodiment, a xenon lamp was used. As paper S, fan-fold paper (continuous paper with feed holes) was used.

As shown in FIG. 1, in the electrophotographic printer 10, the carrying path for paper S extending from a transfer section where the transfer charger 15 is arranged to a fixing section where the flash lamp 23 is arranged is provided substantially as a straight line.

In the electrophotographic printer 10 structured as above, first the surface of the photoconductor 11 is uniformly charged to be 680V with the main charger 12. Then, it is exposed to light from the LED array 13 in accordance with image information so that an electrostatic latent image is formed on the photoconductor 11.

Then, using the developer unit 14 to which bias for development of 480V is applied, the electrostatic latent image is developed with positively charged toner particles so that a toner image is formed on the surface of the photoconductor 11.

Then, the paper S is carried with the tractor 20, and the toner image is transferred from the photoconductor 11 to the paper S with the transfer charger 15.

Then, the paper S having the toner image transferred to is carried with the carrying belt 21, and flash light from the flash lamp 23 that turns on intermittently at a frequency of 6.5 Hz is applied so that the toner image is fixed to the paper S. Here, the toner image is heated with the flash light it absorbs, and fixed to the paper S.

On the other hand, after the toner image is transferred from the photoconductor 11 to the paper S, the surface of the photoconductor 11 is secondarily charged by the secondary charger 17 to have the same polarity as a polarity given by the main charger 12 and a surface potential V1 larger in absolute value than a surface potential given by the main charger 12. Then, the surface of the photoconductor 11 is cleaned with the cleaner 18. Here, bias voltage of −300V is applied to the cleaner 18, and the toner particles remaining on the surface of the photoconductor 11 are absorbed and removed electrically with the conductive brush.

Finally, the charge remaining on the surface of the photoconductor 11 is removed with the discharing lamp 19, and the photoconductor 11 goes to the next cycle of printing.

With the above-described image forming process, printing was carried out varying the surface potential V1 of the photoconductor 11 given by the secondary charger 17 of the electrophotographic printer 10. With each value of the surface potential V1, 600,000 sheets of paper were printed in a state of continuous paper of 8.5 inch in top-to-bottom length. For each surface potential V1, variation in surface potential $\Delta V$ of the photoconductor 11 directly after the photoconductor 11 passing the main charger 12 was measured after 200,000 sheets were printed, and the presence of printing defects due to stains on a white ground produced in accordance with the flash lamp 23 being periodically turned on was observed with the eye after 200,000 sheets were printed, after 400,000 sheets were printed, and after 600,000 sheets were printed. The result is shown in table 1. Here, the surface potential was measured with MODEL362A manufactured by TREK Japan K.K.

TABLE 1

| V1 | Variation ΔV after 200,000 sheets were printed | Printing defects after 200,000 sheets were printed | Printing defects after 400,000 sheets were printed | Printing defects after 600,000 sheets were printed |
|---|---|---|---|---|
| 480 V | 85 V | Produced | Produced | Produced |
| 625 V | 55 V | None | Slightly produced | Produced |
| 760 V | 30 V | None | None | None |
| 890 V | 15 V | None | None | None |

From the result shown in table 1, it is apparent that as the surface potential V1 of the photoconductor 11 given by the secondary charging increases, the variation VΔ in surface potential decreases. It is also apparent that when the surface potential V1 is made larger than the surface potential (=680 V) directly after the photoconductor passing the main charger 12, the surface potential is stable for a long time and stains on a white ground are prevented.

Figures 2A, 2B:
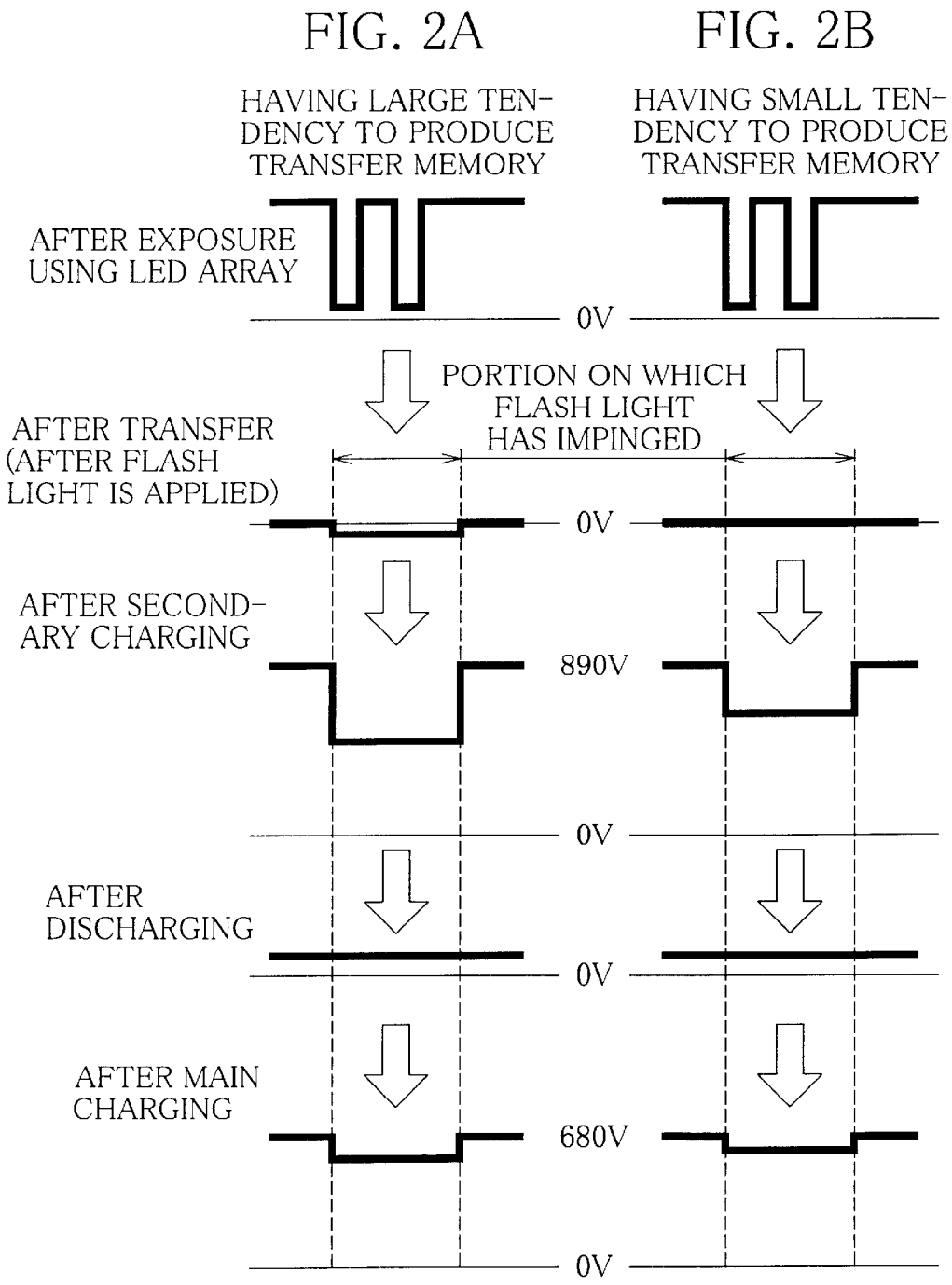
FIGS. 2A and 2B show how the surface potential of a photoconductor of the electrophotographic printer of FIG. 1 varies after each step.

FIGS. 2A and 2B show how the surface potential of the photoconductor 11 varied after each step, when the surface potential V1 of the photoconductor 11 given by the secondary charging was arranged to be 890 V. Here, FIG. 2A relates to a photoconductor 11 having a large tendency to produce transfer memory, and FIG. 2B relates to a photoconductor having a small tendency to produce transfer memory. As is apparent from FIG. 2B, even in the case of a photoconductor having a small tendency to produce transfer memory, the surface potential of the photoconductor after the secondary charging and that after the main charging are low at those portions on which flash light has impinged. This is because the capability to be charged drops due to photo fatigue. When the carrying path for paper S from the transfer section to the fixing section is provided substantially as a straight line as shown in FIG. 1, even thick paper, for example, of 204 g/m$^2$ can be carried well without problems such as printing defects due to mechanical properties such as stiffness of paper S, to be sure. However, when the carrying path for paper S is provided substantially as a straight line, part of flash light scattered at the surface of paper S is hard to intercept with the shielding plate 22, and it is apt to directly impinge on the photoconductor 11. Thus, the capability to be charged is apt to drop more.

The secondary charger 17 can produce the same effect as long as it is arranged to be opposite to the photoconductor 11 between the transfer charger 15 and the discharging lamp 19. The position thereof is not limited to the illustrated one. However, it is desirable that the secondary charger 17 is arranged between the transfer charger 15 and the cleaner 18 as in the present embodiment, because in that case, toner, additive such as silica and polyvinylidene fluoride, paper powder, pieces cut out to provide fan-fold paper with feed holes and the like that remain on the surface of the photoconductor 11 can be charged to have a polarity opposite to the polarity of the conductive brush of the cleaner 18 so that they may be easily removed electrically with the cleaner 18.

Figure 3:
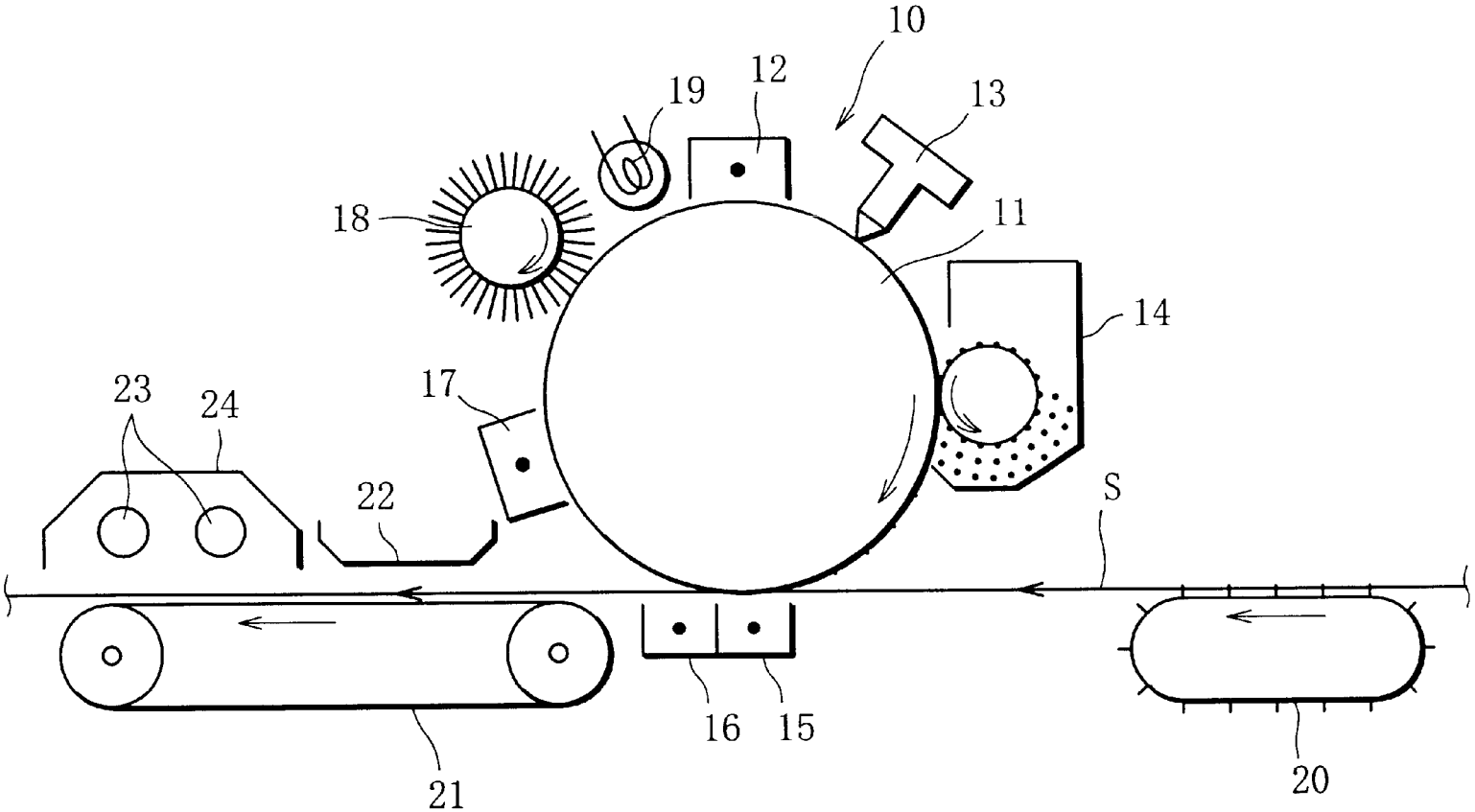
FIG. 3 shows another form of the electrophotographic printer shown in FIG. 1.
Figure 4:
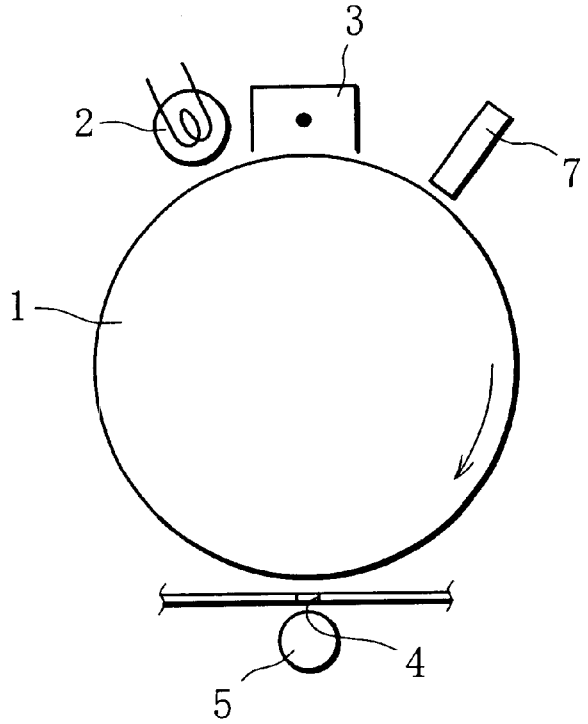
FIG. 4 is a diagram for use in explaining photo fatigue of a photoconductor.
Figure 5:
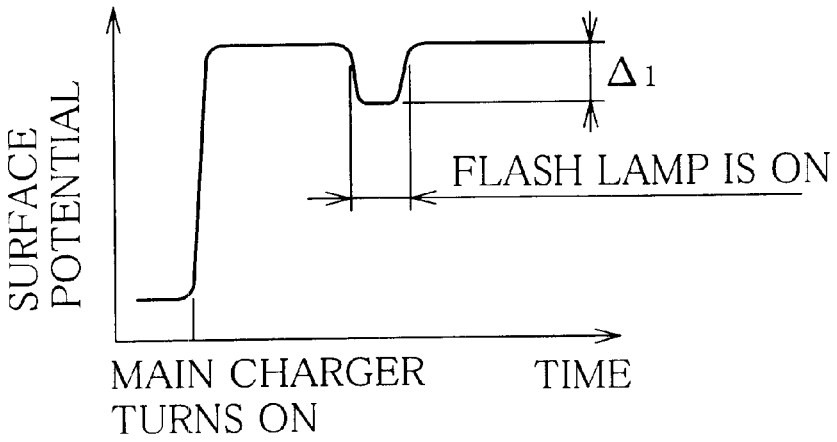
FIG. 5 is a diagram for use in explaining the way of evaluating photo fatigue of a photoconductor.
Figure 6:
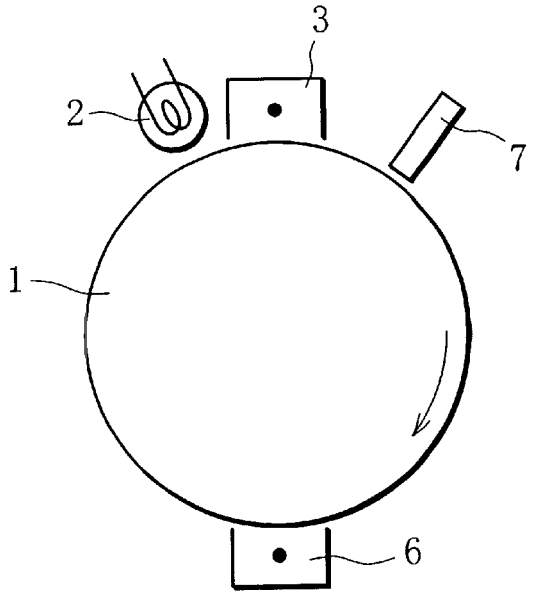
FIG. 6 is a diagram for use in explaining transfer memory of a photoconductor.
Figure 7:
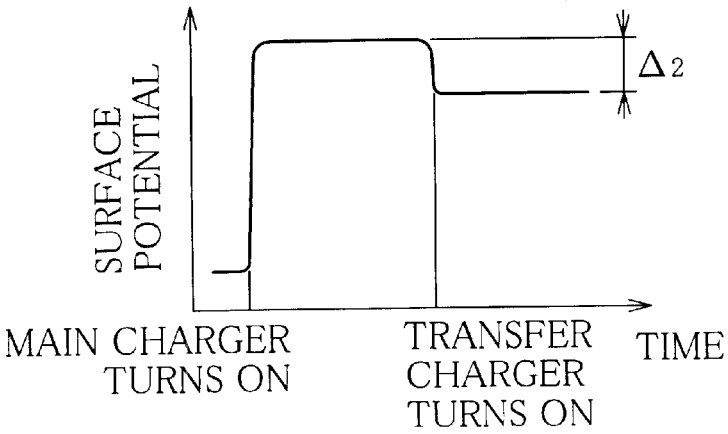
FIG. 7 is a diagram for use in explaining the way of evaluating transfer memory of a photoconductor.
Figure 8:
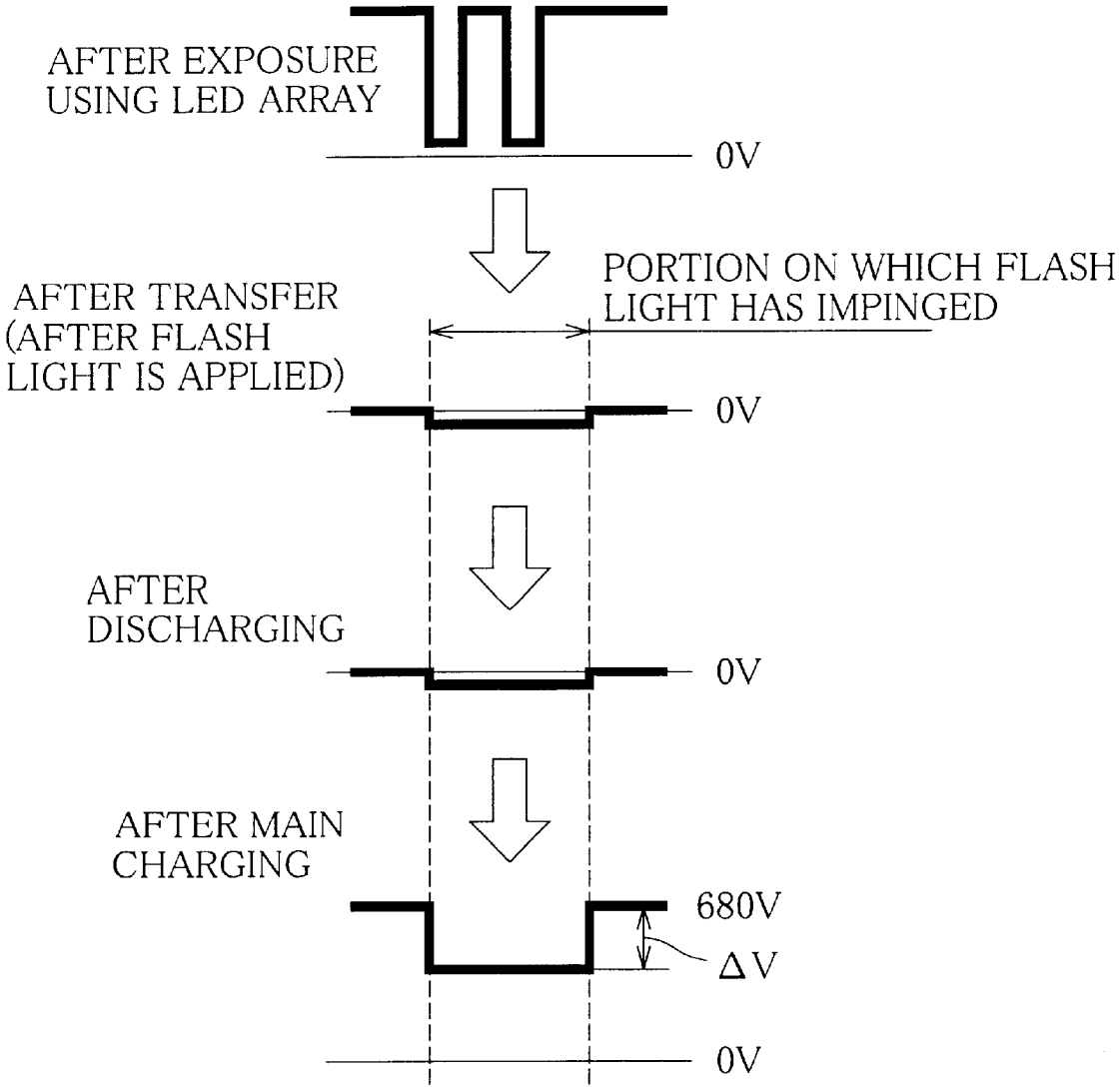
FIG. 8 shows how the surface potential of a deteriorated photoconductor varies after each step.

As shown in FIG. 3, the photographic printer 10 may have two flash lamps 23 adapted to emit light simultaneously. As compared with providing a single flash lamp 23, providing two flash lamps 23 and making them emit light simultaneously is advantageous in the following respects: 1) A toner image can be fixed to paper S more firmly. 2) A toner image of a larger area can be fixed to paper S with a single emission of flash light. 3) Since the amount of light emitted from one flash lamp 23 can be reduced, the flash lamps 23 can be cooled more easily.

On the other hand, a larger amount of light is emitted at a time with two flash lamps 23 than with a single flash lamp. Therefore, the amount of flash light impinging on the photoconductor 11 increases, and the capability of the photoconductive drum 11 to be charged drops more. However, in the present invention, prior to discharging, the photoconductive drum 11 is subjected to the secondary charging that gives the same polarity as the main charging gives and a surface potential larger in absolute value than the main charging gives. Therefore, when the present invention is applied to the case where the amount of flash light is supposed to increase and the capability of the photoconductive drum 11 to be charged is feared to drop, printing defects are prevented more remarkably.

Though the above-described embodiment of the electrophotographic printer 10 uses a positively-charged photoconductor 11, a negatively-charged photoconductor may be used. In that case, the main charger 12 and the secondary charger 17 are those for negative charging.

INDUSTRIAL UTILITY

According to first to twelfth aspects of the present invention, an image forming method and image forming apparatus can be provided in which a recording medium is carried well and the possibility of producing stains on a white ground is low even if flash light impinges on an image carrier.

What is claimed is:

1. An image forming method in which a toner image formed on an image carrier through steps of discharing, main charging, exposure and development is transferred to a recording medium and then fixed as an image using flash light, wherein after the toner image is transferred, the image carrier is subjected, prior to discharging, to secondary charging that gives the same polarity as said main charging gives and a surface potential larger in absolute value than said main charging gives.

2. An image forming method according to claim 1, wherein said recording medium is continuous paper.

3. An image forming method according to claim 1, wherein a carrying path along which said recording medium is carried while said toner image is transferred and then fixed is substantially a straight line.

4. An image forming method according to claim 1, wherein the development through which said toner image is formed is reversal development.

5. An image forming method according to claim 1, wherein said image carrier is an organic photoconductor.

6. An image forming method according to claim 1, wherein said flash light is emitted from a plurality of light sources simultaneously.

7. An image forming apparatus comprising at least an image carrier, main charging means, exposure means, development means, transfer means for transferring an image to a recording medium, discharging means, fixing means using a flash lamp, carrying means for carrying said recording medium to transfer position to fixing position, and secondary charging means for secondarily charging said image carrier to have the same polarity as a polarity given by said main charging means and a surface potential larger in absolute value than a surface potential given by said main charging means, said secondary charging means being arranged to act on a portion of said image carrier where said transfer means has already acted and where said discharging means has not acted yet.

8. An image forming apparatus according to claim 7, wherein said recording medium is continuous paper.

9. An image forming apparatus according to claim 7, wherein said carrying means carries said recording medium along a carrying path that is substantially a straight line.

10. An image forming apparatus according to claim 7, wherein said development means is means for performing reversal development.

11. An image forming apparatus according to claim 7, wherein said image carrier is an organic photoconductor.

12. An image forming apparatus according to claim 7, wherein said fixing means comprises a plurality of flash lamps adapted to emit light simultaneously.

* * * * *

UNITED STATES PATENT AND TRADEMARK OFFICE

CERTIFICATE OF CORRECTION

PATENT NO. : 6,415,122 B1
DATED : July 2, 2002
INVENTOR(S) : Hidetoshi Hara et al.

It is certified that error appears in the above-identified patent and that said Letters Patent is hereby corrected as shown below:

Title page,
Item [73], Assignee, please correct the assignee from "Toray Industries, Inc., Tokyo [JP]" to -- Toray Engineering Co. Ltd., Osaka [JP] --.

Signed and Sealed this

Sixth Day of May, 2003

JAMES E. ROGAN
*Director of the United States Patent and Trademark Office*